US010035279B2

(12) United States Patent
Tsuchiya

(10) Patent No.: US 10,035,279 B2
(45) Date of Patent: Jul. 31, 2018

(54) CORRUGATED PAPERBOARD SHEET PROCESSING APPARATUS, CORRUGATED PAPERBOARD SHEET COMPOSITE PROCESSING APPARATUS, AND PROCESSING MODULE

(71) Applicant: KABUSHIKI KAISHA ISOWA, Nagoya-shi, Aichi (JP)

(72) Inventor: Satoru Tsuchiya, Kasugai (JP)

(73) Assignee: KABUSHIKI KAISHA ISOWA, Nagoya-Shi, Aichi (JP)

( * ) Notice: Subject to any disclaimer, the term of this patent is extended or adjusted under 35 U.S.C. 154(b) by 0 days.

(21) Appl. No.: 15/254,356

(22) Filed: Sep. 1, 2016

(65) Prior Publication Data

US 2017/0072578 A1 Mar. 16, 2017

(30) Foreign Application Priority Data

Sep. 11, 2015 (JP) ..... 2015-179626

(51) Int. Cl.

| | |
|---|---|
| ***B26D 3/08*** | (2006.01) |
| ***B26D 9/00*** | (2006.01) |
| ***B26D 7/12*** | (2006.01) |
| ***B26D 1/16*** | (2006.01) |
| ***B26D 7/26*** | (2006.01) |

(52) U.S. Cl.

CPC ..... *B26D 3/085* (2013.01); *B26D 1/165* (2013.01); *B26D 7/12* (2013.01); *B26D 7/2621* (2013.01); *B26D 9/00* (2013.01)

(58) Field of Classification Search

CPC ..... B26D 3/085; B26D 1/165; B26D 7/12; B26D 7/2621; B26D 9/00

USPC ..... 83/174, 508.2

See application file for complete search history.

(56) References Cited

U.S. PATENT DOCUMENTS

| | | | | |
|---|---|---|---|---|
| 5,370,026 | A * | 12/1994 | Cavagna | B26D 1/245 83/478 |
| 6,253,652 | B1 * | 7/2001 | Dax | B26D 7/2621 83/481 |
| 7,086,173 | B1 * | 8/2006 | Alatalo | B26D 7/00 33/628 |
| 2011/0036220 | A1 * | 2/2011 | Paulson | B26D 1/245 83/13 |
| 2012/0031251 | A1 * | 2/2012 | Momonaka | B26D 1/245 83/864 |

FOREIGN PATENT DOCUMENTS

JP 2013-202717 A 10/2013

* cited by examiner

*Primary Examiner* — Omar Flores Sanchez
(74) *Attorney, Agent, or Firm* — Brinks Gilson & Lione

(57) ABSTRACT

A corrugated paperboard sheet processing apparatus for processing a corrugated paperboard sheet being conveyed. The apparatus includes a threaded shaft and a support assembly supported by the threaded shaft. The apparatus further includes a processing module supported by the support assembly. The processing module includes a width-direction movement motor for rotating a rotor provided in the support assembly, a processing tool for performing a given processing on the corrugated paperboard sheet, a processing tool drive device for driving the processing tool to perform the given processing, and an up-down movement motor for moving the processing tool in the up-down direction. The processing module is formed to define itself as independent and separable from the support assembly.

6 Claims, 7 Drawing Sheets

CORRUGATED PAPERBOARD SHEET PROCESSING APPARATUS, CORRUGATED PAPERBOARD SHEET COMPOSITE PROCESSING APPARATUS, AND PROCESSING MODULE

RELATED APPLICATIONS

This application claims priority under 35 U.S.C. § 119 to Japanese Patent Application No. 2015-179626 filed on Sep. 11, 2015, the entire content of which is hereby incorporated by reference.

BACKGROUND OF THE INVENTION

1. Field of the Invention

The present invention relates to a corrugated paperboard sheet processing apparatus, a corrugated paperboard sheet composite processing apparatus and a processing module, and more particularly to: a corrugated paperboard sheet processing apparatus for processing a corrugated paperboard sheet being conveyed, by moving a processing tool in an up-down direction and a width direction of the corrugated paperboard sheet; a corrugated paperboard sheet composite processing apparatus for performing various types of processing of a corrugated paperboard sheet; and a processing module for processing a corrugated paperboard sheet.

2. Description of the Related Art

Heretofore, a corrugated paperboard sheet processing apparatus for performing given processing of a corrugated paperboard sheet, such as a slitter apparatus for slitting the corrugated paperboard sheet being conveyed, has been employed in a corrugated paperboard sheet manufacturing machine (corrugator).

For example, Patent Document 1 (JP-A-2013-202717) discloses a slitter 1 comprising a plurality of slitter blade units 4 coupled to a lower threaded shaft 12 and a lower rotational drive shaft 14 each extending in a width direction (lateral direction) of the corrugated paperboard sheet. Specifically, this slitter 1 comprises: a rotational drive motor 15 operable to rotationally drive a slitter blade 50 through the lower rotational drive shaft 14; a lateral movement servomotor 39 operable to move the slitter blade unit 4 along the lower threaded shaft 12 in a width direction; a raising-lowering servomotor 47 operable to move the slitter blade 50 in an up-down direction.

SUMMARY OF THE INVENTION

Technical Problem

Meanwhile, when a malfunction or breakdown occurs in any one of a plurality of corrugated paperboard sheet processing apparatuses in a corrugated paperboard sheet manufacturing machine, production in the entire line of the corrugated paperboard sheet manufacturing machine is generally stopped. Therefore, from a viewpoint of shortening a time period during which the production in the entire line is interrupted, it is desirable to quickly perform treatment for the broken corrugated paperboard sheet processing apparatus (specifically, replacement of a broken component with a normal one).

However, in a situation where a component of the slitter blade unit 4 has broken down, the slitter 1 disclosed in the Patent Document 1 tends to require a long time for replacing the broken component with a normal one. Specifically, it takes a long time for an operation to cope with the breakdown, because it comprises: identify a broken one of a plurality of components in the slitter blade unit 4; detaching the identified broken component from the slitter blade unit 4 separately; and attaching a new component to the slitter blade unit 4. For example, when a motor, such as the raising-lowering servomotor 47 or the lateral movement servomotor 39, has broken down, it is necessary to perform an operation of detaching a motor cover, an operation of detaching a coupling or a pulley, an operation of detaching a connector and other operations, during detachment of the motor, and to perform these operations in a reverse manner, during attachment of a new motor. Particularly, in breakdown of the raising-lowering servomotor 47, it takes a longer time for the operations, because it is additionally necessary to perform adjustment for positioning after a new motor is attached.

For the above reason, when a breakdown occurs in the slitter disclosed in the Patent Document 1, the production in the entire line of the corrugated paperboard sheet manufacturing machine tends to be stopped for a long time.

It is therefore an object of the present invention to provide a corrugated paperboard sheet processing apparatus, a corrugated paperboard sheet composite processing apparatus and a processing module, which are capable of shortening a time for an operation to cope with breakdown of the corrugated paperboard sheet processing apparatus.

Solution to Problem

In order to achieve the above object, according to a first aspect of the present invention, there is provided a corrugated paperboard sheet processing apparatus for processing a corrugated paperboard sheet being conveyed, by moving a processing tool in an up-down direction and an width direction of the corrugated paperboard sheet. The corrugated paperboard sheet processing apparatus comprises: a threaded shaft disposed to extend in the width direction of the corrugated paperboard sheet; a rotor threadingly engaged with the threaded shaft; a support member rotatably holding the rotor and configured to move along the threaded shaft in the width direction of the corrugated paperboard sheet, in accordance with rotation of the rotor; and a processing module supported by the support member and configured to process the corrugated paperboard sheet being conveyed. The processing module is constructed by assembling together a plurality of components which comprise: a width-direction movement motor for rotating the rotor in order to move the support member in the width direction of the corrugated paperboard sheet together with the said processing module; a processing tool for performing given processing of the corrugated paperboard sheet being conveyed; a processing tool drive device for driving the processing tool to make the processing tool perform the given processing; and an up-down movement motor for moving the processing tool in the up-down direction, wherein the processing module is configured so that the width-direction movement motor, the processing tool, the processing tool drive device and the up-down movement motor are integrally detached from the support member.

In the corrugated paperboard sheet processing apparatus according to the first aspect of the present invention, the processing module is constructed by integrally assembling the processing tool for performing the given processing with respect to the corrugated paperboard sheet, the processing tool drive device for driving the processing tool, and the width-direction and up-down movement motors for moving the processing tool in the width and up-down directions of the corrugated paperboard sheet, wherein the processing module is configured such that an entirety thereof can be attached and detached with respect to the rotor threadingly engaged with the threaded shaft disposed to extend in the width direction of the corrugated paperboard sheet, and the support member holding the rotor. Thus, in the first aspect of the present invention, a plurality of components comprised in the corrugated paperboard sheet processing apparatus are integrally assembled to form the processing module, wherein the threaded shaft is kept from penetrating the processing module, and the processing module is configured such that an entirety thereof can be attached and detached with respect to the support member coupled to the threaded shaft. As used in this specification, a direction along a width direction of a corrugated paperboard sheet being conveyed, and a direction orthogonal to a direction of the conveyance (conveyance direction) of the corrugated paperboard sheet is defined as "width direction of the corrugated paperboard".

In the first aspect of the present invention, when a malfunction or breakdown occurs in the processing module of the corrugated paperboard sheet processing apparatus, the entire processing module can be detached from the support member, whereafter another new processing module may be attached to the support member, so that it becomes possible to easily and quickly cope with a breakdown, as compared to the conventional technique of, in a situation where a plurality of components comprised in a corrugated paperboard sheet processing apparatus are not modularized, identifying a broken one of the components and performing replacement with respect to each component. Specifically, in the first aspect of the present invention, a plurality of components comprised in the corrugated paperboard sheet processing apparatus are integrally constructed as the processing module capable of being attached and detached with respect to the support member. Thus, when a breakdown occurs somewhere in the processing module, irrespective of in which of the components of the processing module the breakdown occurs, it becomes possible to adequately cope with the breakdown by replacing the entire processing module with a new one, without the operation of identifying a broken one of the components and replacing the identified component with a new one, individually. In this case, it is possible to perform a replacement operation to cope with a breakdown, within a shorter period of time, irrespective of in which of the components of the processing module the breakdown occurs.

As mentioned above, the first aspect of the present invention makes it possible to significantly shorten a time for a replacement operation to cope with a breakdown of the corrugated paperboard sheet processing apparatus, and therefore effectively reduce a time period during which production in the entire line of a corrugated paperboard sheet manufacturing machine (corrugator) is interrupted in the event of the breakdown of the corrugated paperboard sheet processing apparatus.

Preferably, in the first aspect of the present invention, the processing module further comprise a detachable member which is detachably attached to the support member, and to which the width-direction movement motor and the up-down movement motor are fixed, wherein the width-direction movement motor is coupled to the rotor by a belt, and wherein the up-down movement motor moves the processing tool drive device together with the processing tool, in the up-down direction with respect to the detachable member.

According to this feature, the entire processing module can be easily detached from the support member by: detaching, from the width-direction movement motor of the processing module, the belt which couples the width-direction movement motor and the rotor together; and detaching, from the support member, the detachable member of the processing module, to which the width-direction movement motor and the up-down movement motor are fixed. Then, a new processing module can also be easily attached to the support member by: attaching the detachable member of the processing module to the support member; and attaching the belt to a pulley of the width-direction movement motor of the processing module to couple the rotor and the width-direction movement motor together. Therefore, this feature makes it possible to further shorten the time for the replacement operation to cope with a breakdown of the corrugated paperboard sheet processing apparatus.

Preferably, in the first aspect of the present invention, the processing tool of the processing module is a slitter knife for slitting the corrugated paperboard sheet.

In this case, the first aspect of the present invention is employed in a slitter apparatus for slitting the corrugated paperboard sheet by the slitter knife. In the slitter apparatus, as a feature of the processing of slitting the corrugated paperboard sheet, a load is inevitably applied to each component and therefore a breakdown is more likely occur due to wear or the like. Thus, it is an effective way to employ the above processing module in the slitter apparatus.

Preferably, in the first aspect of the present invention, the processing module further comprise a grinding device for grinding the slitter knife, and wherein the up-down movement motor moves the grinding device together with the slitter knife, in the up-down direction.

According to this feature, the grinding device for grinding the slitter knife is incorporated into the processing module, so that it becomes possible to replace the processing module, including the grinding device. In addition, according to this feature, the up-down movement motor is operable to move the grinding device together with the slitter knife, in the up-down direction, so that the grinding device can be disposed at a position appropriate to an up-down position of the slitter knife to thereby allow grinding for the slitter knife to be adequately performed by the grinding device.

According to a second aspect of the present invention, there is provided a corrugated paperboard sheet composite processing apparatus for performing various types of processing of a corrugated paperboard sheet. The corrugated paperboard sheet composite processing apparatus comprises: a first processing apparatus composed of the above corrugated paperboard sheet processing apparatus; a second processing apparatus provided on an upstream or downstream side of the first processing apparatus and disposed adjacent to the first processing apparatus, the second processing apparatus configured to perform processing of the corrugated paperboard sheet being conveyed which is different from processing by first processing apparatus; and a movement mechanism for moving at least one of the first processing apparatus and the second processing apparatus in a direction parallel to a conveyance direction of the corrugated paperboard sheet to allow the first and second processing apparatuses to be spaced apart from each other.

In the second aspect of the present invention, when a worker performs a replacement operation for the processing module of the first processing apparatus, the first processing apparatus and the second processing apparatus can be spaced apart from each other to adequately create a workspace for the worker. This makes it possible to more quickly and easily perform the replacement operation for the processing module of the first processing apparatus and thus further shorten a time period during which the production in the entire line of the corrugated paperboard sheet manufacturing machine (corrugator) is interrupted in the event of the breakdown.

According to a third aspect of the present invention, there is provided a processing module for processing a corrugated paperboard sheet. The processing module comprises: a processing tool for performing given processing of the corrugated paperboard sheet; a processing tool drive device for driving the processing tool to make the processing tool perform the given processing; and an up-down movement motor for moving the processing tool in an up-down direction; a width-direction movement motor for rotating a rotor threadingly engaged with a threaded shaft disposed to extend in a width direction of the corrugated paperboard sheet, in order to move a support member rotatably holding the rotor, along the threaded shaft in the width direction of the corrugated paperboard sheet, wherein the processing module is configured so that the processing tool, the processing tool drive device, the up-down movement motor and the width-direction movement motor are integrally attached to and detached from the support member.

The processing module according to the third aspect of the present invention can be employed in a corrugated paperboard sheet processing apparatus to significantly shorten a time for an operation to cope with a breakdown of the corrugated paperboard sheet processing apparatus.

The corrugated paperboard sheet processing apparatus, the corrugated paperboard sheet composite processing apparatus and the processing module of the present invention make it possible to shorten a time for an operation to cope with breakdown of the corrugated paperboard sheet processing apparatus.

DETAILED DESCRIPTION OF THE PREFERRED EMBODIMENTS

With reference to the accompanying drawings, a corrugated paperboard sheet processing apparatus, a corrugated paperboard sheet composite processing apparatus and a processing module according to the present invention will now be described based on an embodiment thereof.

<Overall Configuration of Slitter Apparatus>

Figure 1:
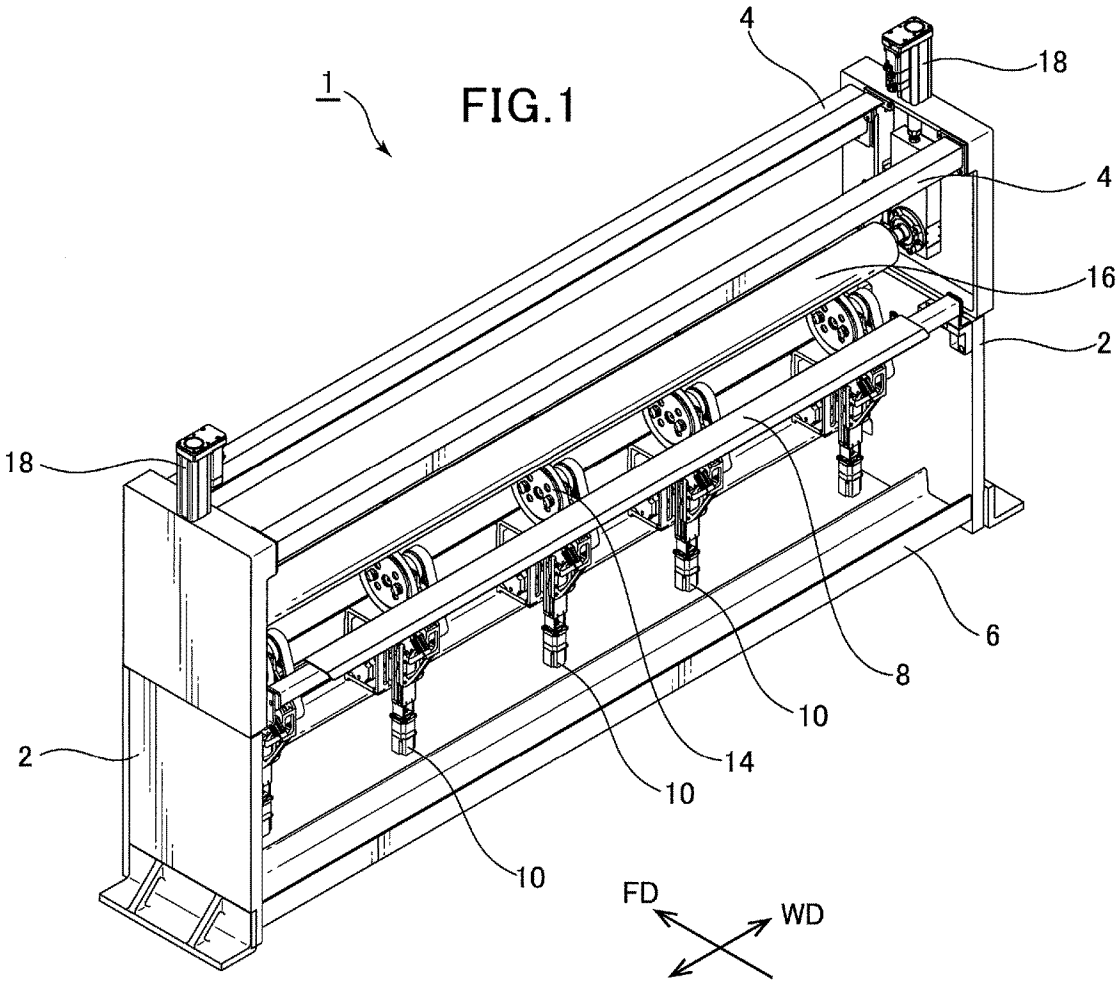
FIG. 1 is a perspective view depicting an overall configuration of a slitter apparatus according to an embodiment of the present invention.

With reference to FIG. 1, an overall configuration of a slitter apparatus as a corrugated paperboard sheet processing apparatus according to an embodiment of the present invention will be described. FIG. 1 is a perspective view depicting the overall configuration of the slitter apparatus according to the present embodiment.

As depicted in FIG. 1, the slitter apparatus 1 comprises: a pair of frames 2 opposed to each other in a width direction WD of a corrugated paperboard sheet which is not depicted (hereinafter referred to arbitrarily as "sheet-width direction") orthogonal to a conveyance direction FD of the corrugated paperboard sheet; and an upper beam 4 and a lower beam 6 are installed between the pair of frames 2. The slitter apparatus 1 is configured such that the corrugated paperboard sheet is supplied thereto while being guided by a plate-shaped sheet guide 8 disposed on an upstream side in the conveyance direction FD to extend the sheet-width direction WD. On a downstream side of the sheet guide 8, a plurality of (in the present embodiment depicted in FIG. 1, five) slitter knife units 10 arranged along a threaded shaft (not depicted) disposed to extend in the sheet-width direction WD are provided.

In each of the slitter knife units 10, a slitter knife 14 as a processing tool is provided on an upper side thereof to perform a processing of slitting the corrugated paperboard sheet. Although details will be described later, the slitter knife unit 10 is configured to be moved in the sheet-width direction WD by a width-direction movement mechanism comprising a motor, wherein the slitter knife 14 of the slitter knife unit 10 is configured to be moved between a position where slitting is performed (processing position) and a position where no slitting is performed (standby position), in an up-down direction by an up-down movement mechanism comprising a motor. Further, the slitter knife 14 of the slitter knife unit 10 is configured to be rotationally driven by the motor.

Specifically, in the slitter apparatus 1, one or more of the plurality of slitter knife units 10 to be used for slitting are selected in accordance with a desired division number, i.e., a desired number of output sheets to be divided from the corrugated paperboard sheet, a desired division width, i.e., a desired width-direction length of each of the output sheets to be divided, or the like, and the slitter knives 14 of the plurality of slitter knife units 10 are moved in the up-down direction, in such a manner that the slitter knife 14 in each of the selected slitter knife units 10 is set at the processing position, and the slitter knife 14 in each of the non-selected slitter knife units 10 is set at the standby position. Further, in the slitter apparatus 1, in order to set each of the selected slitter knife units 10 for use in slitting at a sheet width-directional position (position in the sheet-width direction WD) in accordance with a desired division width or the like, the slitter knife units 10 are moved in the sheet-width direction WD.

The slitter apparatus 1 further comprises a knife receiving roll 16 disposed to extend in the sheet-width direction WD and configured to receive the slitter knife 14 in each of the slitter knife units 10. Specifically, the knife receiving roll 16 is rotatably supported just above the slitter knife units 10, and is formed as a brush (brush roll) configured to allow each of the slitter knives 14 to be inserted thereinto. The knife receiving roll 16 is configured to be moved in the up-down direction by a raising-lowering mechanism 18 comprising a motor.

In addition to the above components, the slitter apparatus 1 comprises a dust collection device for collecting dust such as paper pieces generated from the corrugated paperboard sheet through slitting, and a guide roller for guiding the corrugated paperboard sheet being conveyed.

<Configurations of Slitter Knife Unit and Processing Module>

Figure 2:
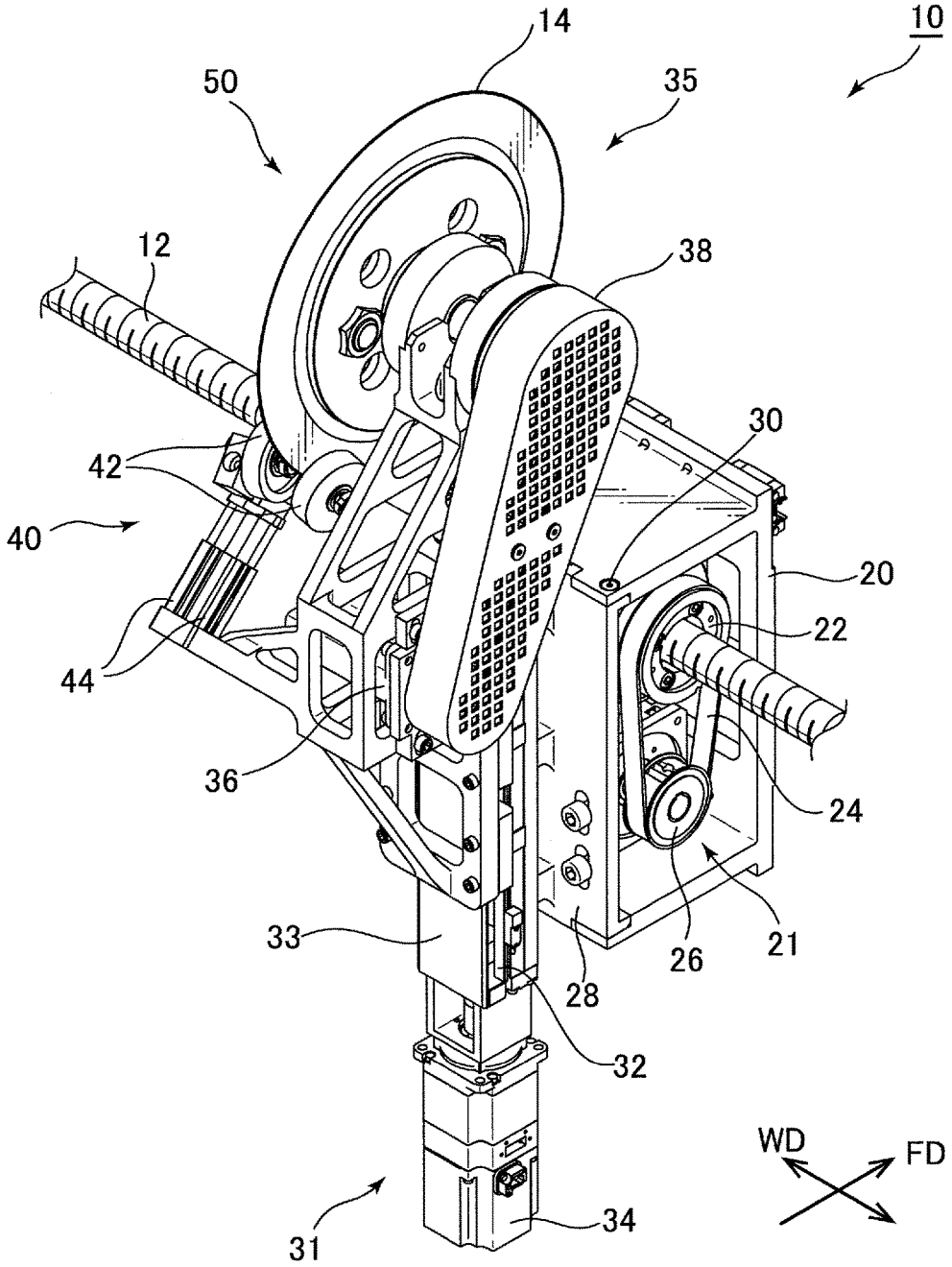
FIG. 2 is a perspective view depicting a slitter knife unit in an embodiment of the present invention.
Figure 3:
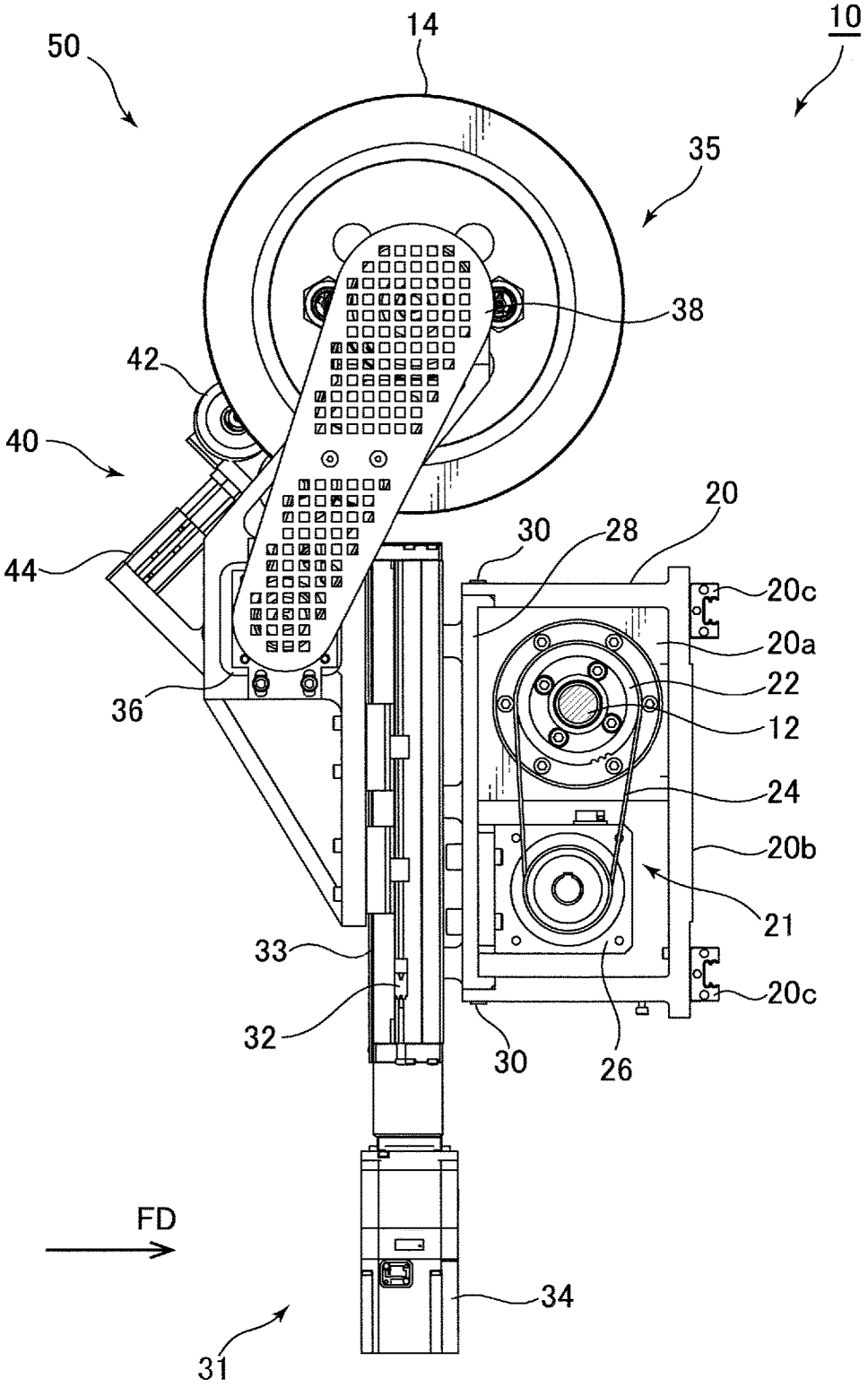
FIG. 3 is a side view depicting the slitter knife unit in an embodiment of the present invention.

With reference to FIGS. 2 and 3, the slitter knife units 10 of the slitter apparatus 1 will be more specifically described below. FIG. 2 is a perspective view depicting the slitter knife unit 10 in the present embodiment, and FIG. 3 is a side view depicting the slitter knife unit 10 in the present embodiment. Each of FIGS. 2 and 3 depicts only one of the plurality of slitter knife units 10 of the slitter apparatus 1.

As depicted in FIGS. 2 and 3, the slitter knife unit 10 is attached to a threaded shaft 12 which is disposed to extend in the sheet-width direction WD and penetrate through the slitter knife unit 10. Specifically, the slitter knife unit 10 comprises a frame 20 as a support member, and a rotor 22 rotatably held by the frame 20. The rotor 22 held by the frame 20 is threadingly engaged with the threaded shaft 12, so that the slitter knife unit 10 is attached to the threaded shaft 12. More specifically, the frame 20 has an approximately angular-C shaped outer shape, and comprises a plate-shaped portion 20*a* integrally formed thereinside to extend in a direction parallel to the conveyance direction FD. The rotor 22 is rotatably attached to the plate-shaped portion 20*a* (see FIG. 3). A width-direction movement motor 26 is coupled to the rotor 22 by a timing belt 24.

The width-direction movement motor 26 is operable, upon activation thereof, to rotate the rotor 22 by the timing belt to thereby move the entire slitter knife unit 10 comprising the frame 20, in the sheet-width direction WD. The slitter knife unit 10 is moved in the sheet-width direction WD by the width-direction movement motor 26, so as to set the slitter knife unit 10 at a sheet width-direction position in accordance with a desired division width or the like, as mentioned above. A combination of the rotor 22, the timing belt 24 and the width-direction movement motor 26 makes up a width-direction movement mechanism 21. The frame 20 further comprises an approximately angular-C-shaped guide member 20*c* attached to a back surface 20*b* thereof (see FIG. 3). The guide member 20*c* is configured such that a rail (not depicted) provided in the slitter apparatus 1 to extend in the sheet-width direction WD is slidably engaged therewith to guide the width-direction movement of the slitter knife unit 10.

Further, a plate-shaped detachable member 28 is detachably fastened to the frame 20 by a bolt 30 (e.g., four bolts 30 each provided in a respective one of the vicinities of four corners of the detachable member 28) in such a manner as to close an opening of the approximately angular-C shaped outer shape. The detachable member 28 has one surface to which the width-direction movement motor 26 is fixed, and the other surface to which an up-down movement mechanism 31 is fixed. The up-down movement mechanism 31 comprises: a threaded shaft 32 disposed to extend in the up-down direction; a housing 33 fixed to the detachable member 28; and an up-down movement motor 34 coupled to the threaded shaft 32 and operable to rotate the threaded shaft 32. A slitter knife section 35 comprising the slitter knife 14, and a grinding device 40 for grinding the slitter knife 14, are attached to the threaded shaft 32 of the up-down movement mechanism 31, in such a manner that, when the up-down movement motor 34 is activated to rotate the threaded shaft 32, the slitter knife section 35 and the grinding device 40 attached to the threaded shaft 32 are moved in the up-down direction. The slitter knife section 35 comprising the slitter knife 14 is moved in the up-down direction WD by the up-down movement motor 34, so as to set the slitter knife 14 at the processing or standby position in accordance with a desired division number, a desired division width or the like, as mentioned above.

In addition to the slitter knife 14, the slitter knife section 35 comprises: a rotational drive motor 36 as a processing tool drive device coupled to a rotary shaft of the slitter knife 14 by a timing belt (not depicted) and operable to rotationally drive the slitter knife 14; and a cover 38 for covering the timing belt coupling the slitter knife 14 and the rotational drive motor 36, and others. The rotational drive motor 36 is provided in each of the plurality of slitter knife units 10, so that the number of revolutions (rotational speed) of the slitter knife 14 can be changed in each of the plurality of slitter knife units 10. For example, when a first one of the slitter knives 14 has a larger degree of wear than that of a second one of the slitter knives 14, the rotational speed of the first slitter knife 14 can be set to a higher value than that of the second slitter knife 14.

The grinding device 40 comprises a pair of grinding rollers 42 arranged to clamp a lower portion of the slitter knife 14 therebetween (see FIG. 2), so that one surface of the slitter knife 14 can be grinded by an inside surface of one of the grinding rollers 42, and the other surface of the slitter knife 14 can be grinded by an inside surface of the other grinding roller 42. The grinding device 40 further comprises a pair of air cylinders 44 each capable of moving a corresponding one of the pair of grinding rollers 42 in a direction causing the corresponding grinding roller 42 to come close to the slitter knife 14 and in a direction causing the corresponding grinding roller 42 to come away from the slitter knife 14. Thus, a contact state and a non-contact state between the slitter knife 14 and the pair of grinding rollers 42 can be switched by moving the grinding rollers 42 using the air cylinders 44 in the above manner. For example, it is preferable that a slitting distance of the slitter knife 14 is counted (e.g., the slitting distance is counted after completion of previous grinding), and, when the slitting distance reaches a given distance, the air cylinders 44 are driven to cause the grinding rollers 42 to be brought into contact with the slitter knife 14 to thereby polish the slitter knife 14 by the grinding rollers 42.

As mentioned above, the slitter knife unit 10 in the present embodiment is configured such that the detachable member 28 and the frame 20 holding the rotor 22 threadingly engaged with the threaded shaft 12 are detachably fastened together by the bolt 30. Further, the width-direction movement motor 26 of the width-direction movement mechanism 21 and the up-down movement mechanism 31 are fixed to the detachable member 28, and the slitter knife section 35 and the grinding device 40 are attached to the threaded shaft 32 of the up-down movement mechanism 31. Thus, when the detachable member 28 is detached from the frame 20, the detachable member 28, the width-direction movement motor 26, the up-down movement mechanism 31, the slitter knife section 35 and the grinding device 40 are integrally detached. The integral combination of these components makes up a module (processing module 50). As above, in the present embodiment, the detachable member 28, the width-direction movement motor 26, the up-down movement mechanism 31, the slitter knife section 35 and the grinding device 40 are integrally assembled and modularized together, and used as a processing module 50.

Figure 4:
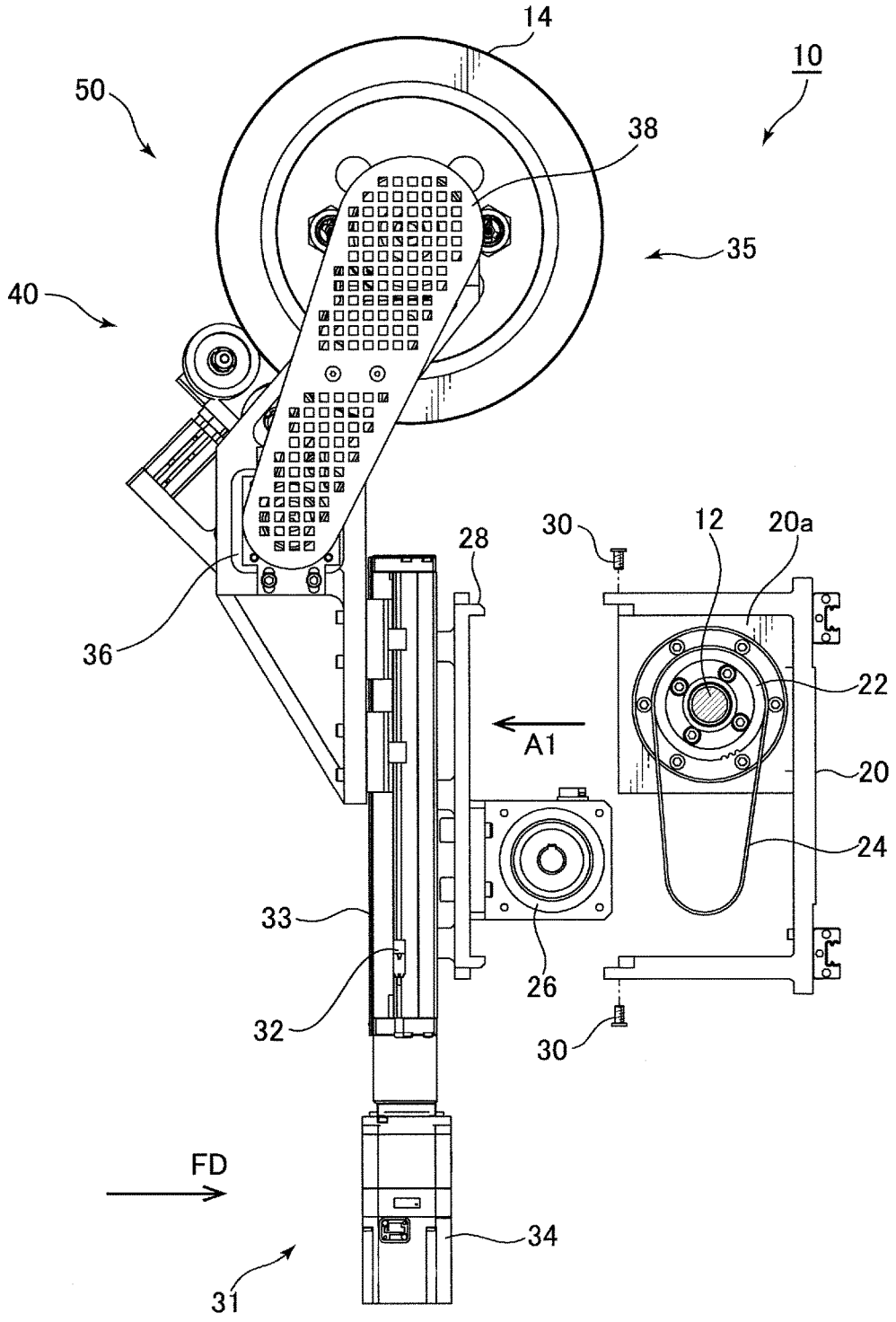
FIG. 4 is a side view depicting a state after a processing module is detached from the slitter knife unit in an embodiment of the present invention.

With reference to FIG. 4, detachment of the processing module 50 from the slitter knife unit 10 will be more specifically described below. FIG. 4 is a side view depicting a state after the processing module 50 is detached from the slitter knife unit 10 in the present embodiment.

When the processing module 50 is detached from the slitter knife unit 10, first of all, the timing belt 24 of the width-direction movement mechanism 21 is loosened, and the width-direction movement motor 26 is disengaged from the timing belt 24. Then, the bolt 30 fastening the frame 20 and the detachable member 28 of the processing module 50 together is unfastened. Further, connectors or the like attached to the width-direction movement motor 26, the up-down movement motor 34 and the rotational drive motor 36 are detached therefrom. Through these operations, the processing module 50 is detached from the slitter knife unit 10, as indicated by the arrowed line A1 in FIG. 4.

When the processing module 50 is attached to the slitter knife unit 10, the above operations may be performed in a reverse manner. Specifically, first of all, connectors or the like are attached, respectively, to the motors 26, 34, 36, and the frame 20 and the detachable member 28 of the processing module 50 are fastened together by the bolt 30. Then, the timing belt 24 may be tightened to allow the width-direction movement motor 26 of the processing module 50 to be coupled thereto.

As the processing module 50 to be attached to the slitter knife unit 10, it is desirable to use a preliminarily-prepared new processing module 50. In this case, in the event of a breakdown of the processing module 50 attached to the slitter knife unit 10, the broken processing module 50 is replaced with a new processing module 50. This makes it possible to cope with the breakdown easily and quickly.

The detached processing module 50 (i.e., the broken processing module) may be taken out from a corrugated paperboard sheet manufacturing plant to identify a breakdown location (broken component), and repair the broken component by dedicated repair staff. This provides enhanced efficiency.

<Configuration of Corrugated Paperboard Sheet Composite Processing Apparatus>

Figure 5:
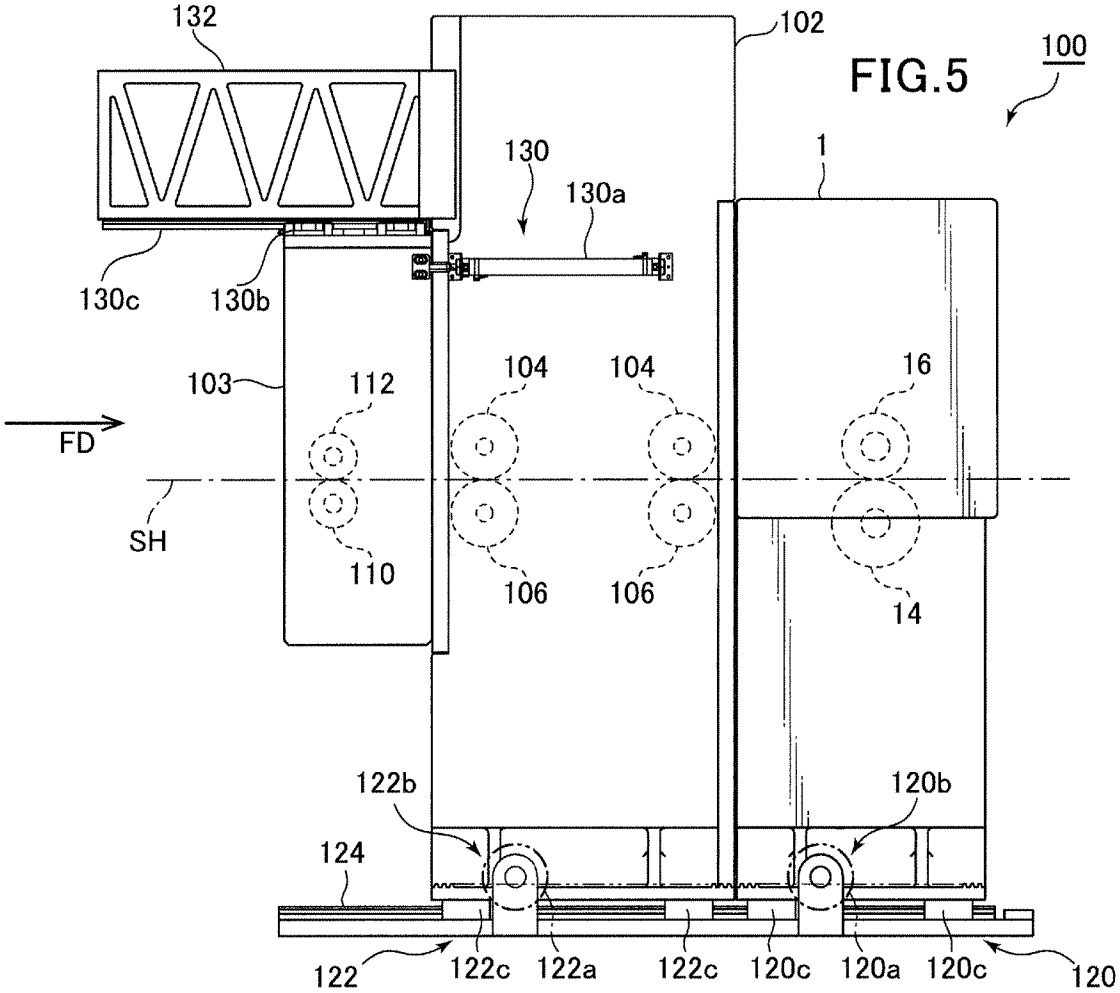
FIG. 5 is a side view schematically depicting a corrugated paperboard sheet composite processing apparatus according to an embodiment of the present invention.
Figure 6:
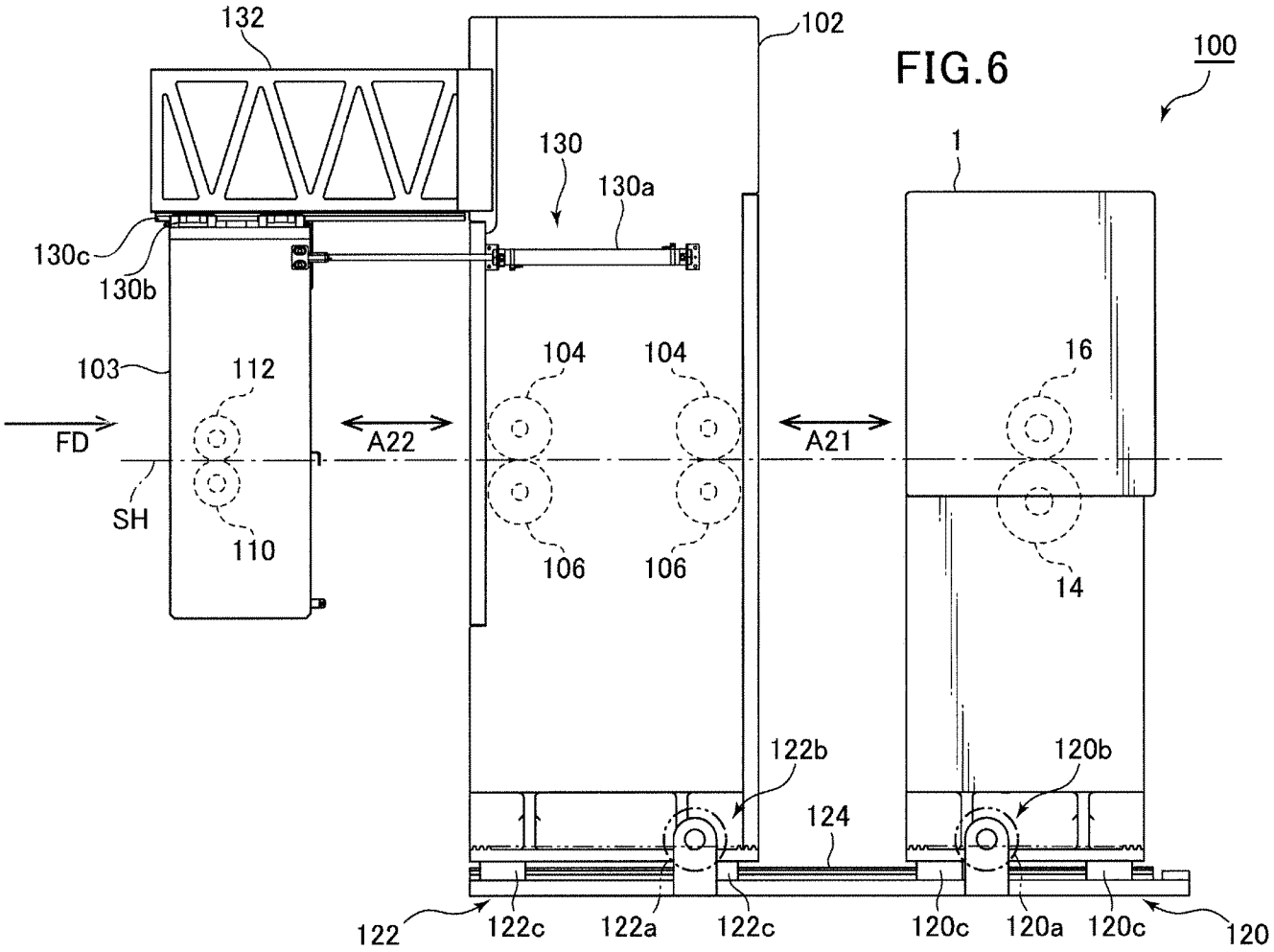
FIG. 6 is a side view depicting a state after at least one of two processing apparatus constituting the corrugated paperboard sheet composite processing apparatus according to an embodiment of the present invention is moved.

With reference to FIGS. 5 and 6, an overall configuration of a corrugated paperboard sheet composite processing apparatus equipped with the above slitter apparatus will be described below. FIG. 5 is a side view schematically depicting the corrugated paperboard sheet composite processing apparatus according to the present embodiment of the present invention, and FIG. 6 is a side view depicting a state after at least one of two processing apparatus constituting the corrugated paperboard sheet composite processing apparatus in FIG. 5 is moved (FIG. 5 depicts a state before the movement). It should be noted that each of FIGS. 5 and 6 primarily depicts frames of the apparatuses, and major components of the apparatuses as viewed through the frames.

As depicted in FIG. 5, in addition to the slitter apparatus 1 (see FIG. 1), the corrugated paperboard sheet composite processing apparatus 100 comprises, as corrugated paperboard sheet processing apparatuses: a scorer apparatus 102 provided on an upstream side of and adjacent to the slitter apparatus 1 and configured to score a corrugated paperboard sheet SH; and a trimming shear apparatus 103 provided on an upstream side of and adjacent to the scorer apparatus 102 and configured to trim unnecessary portions in opposed edge regions of the corrugated paperboard sheet SH in the sheet-width direction WD. This corrugated paperboard sheet composite processing apparatus 100 is employed in a corrugated paperboard sheet manufacturing machine (corrugator). In the corrugated paperboard sheet composite processing apparatus 100 depicted in FIG. 5, the slitter apparatus 1 is equivalent to "first processing apparatus" set forth in the appended claims, and the scorer apparatus 103 is equivalent to "second processing apparatus" set forth in the appended claims.

Specifically, the scorer apparatus 102 comprises an upper scoring roller 104 and a lower scoring roller 106, wherein the scorer apparatus 102 is operable to perform scoring using the upper scoring roller 104 and the lower scoring roller 106. More specifically, in the scorer apparatus 102, a plurality of sets of the upper scoring roller 104 and the lower scoring roller 106 are provided in the sheet-width direction WD, as with the slitter knife units 10 (see FIG. 1). Further, the plurality of sets of the rollers 104, 106 are also tandemly arranged along the conveyance direction FD. On the other hand, the trimming shear apparatus 103 comprises: a pair of trimming knives 110 for trimming unnecessary portions in opposed edge regions of the corrugated paperboard sheet SH; and a knife receiving roll 112 (e.g., brush roll) configured to receive the trimming knives 110.

The corrugated paperboard sheet composite processing apparatus 100 according to the present embodiment is configured to allow each of the slitter apparatus 1, the scorer apparatus 102 and the trimming shear apparatus 103 to be moved in a direction parallel to the conveyance direction FD. Specifically, the slitter apparatus 1, the scorer apparatus 102 and the trimming shear apparatus 103 are provided, respectively, with three movement mechanisms 120, 122, 130 for moving them.

The movement mechanism 120 of the slitter apparatus 1 comprises: a motor 120*a*; a rack-and-pinion mechanism 120*b* coupled to the motor 120*a*; a guide member 120*c* provided on a lower portion of the slitter apparatus 1; and a rail 124 which is provided on a floor and with which the guide member 120*c* is slidably engaged. Specifically, a pinion gear of the rack-and-pinion mechanism 120*b* is coupled to a rotary shaft of the motor 120*a* (the motor 120*a* and the pinion gear are fixed to an outside of the slitter apparatus 1), and a rack gear of the rack-and-pinion mechanism 120*b* is fixed to the lower portion of the slitter apparatus 1 and attached onto the guide member 120*c*. Thus, when the motor 120*a* is rotated, the pinion gear is rotated to move the rack gear, so that the entire slitter apparatus 1 is moved in a direction parallel to the conveyance direction FD while being guided by the guide member 120*c* and the rail 124.

As with the movement mechanism 120 of the slitter apparatus 1, the movement mechanism 122 of the scorer apparatus 102 comprises: a motor 122*a*; a rack-and-pinion mechanism 122*b*; a guide member 122*c*; and the rail 124, whereby the entire scorer apparatus 102 can be moved in a direction parallel to the conveyance direction FD.

When at least one of the slitter apparatus 1 and the scorer apparatus 102 is moved based on the movement mechanisms 120, 122, the slitter apparatus 1 and the scorer apparatus 102 are spaced apart from each other in a direction parallel to the conveyance direction FD, as indicated by the double arrowed line A21 in FIG. 6.

On the other hand, the movement mechanism 130 of the trimming shear apparatus 103 comprises: an air cylinder 130*a* fixed to respective frames of the scorer apparatus 102 and the trimming shear apparatus 103; a guide member 130*b* provided on an upper portion of the trimming shear apparatus 103; a rail 130*c* with which the guide member 130*b* is slidably engaged; and a suspending member 132 fixed to the frame of the scorer apparatus 102 to suspend the trimming shear apparatus 103 through the rail 130*c* and the guide member 130*b* attached to a lower portion thereof. In the movement mechanism 130 of the trimming shear apparatus 103, when the air cylinder 130 is driven, the entire trimming shear apparatus 103 is moved in a direction parallel to the conveyance direction FD while being guided by the guide member 130*b* and the rail 130*c*. Thus, the scorer apparatus 102 and the trimming shear apparatus 103 are spaced apart from each other in a direction parallel to the conveyance direction FD, as indicated by the double arrowed line A22 in FIG. 6.

In the above embodiment, the motors 120*a*, 122*a* and the air cylinder 130*a* are shown as drive means for the movement mechanisms 120, 122, 130. Alternatively, instead of such drive means, a hand-operated rotating handle or the like may be used. In this case, a worker may manually move the slitter apparatus 1, the scorer apparatus 102 and the trimming shear apparatus 103.

Additionally, a foldable sheet guide may be provided between the slitter apparatus 1 and the scorer apparatus 102. In this case, when the slitter apparatus 1 and the scorer apparatus 102 are spaced apart from each other, the foldable sheet guide may be unfolded to guide a corrugated paperboard sheet passing between the slitter apparatus 1 and the scorer apparatus 102. A foldable sheet guide may also be provided between the scorer apparatus 102 and the trimming shear apparatus 103. In this case, when the scorer apparatus 102 and the trimming shear apparatus 103 are spaced apart from each other, the foldable sheet guide may be unfolded to guide a corrugated paperboard sheet passing between the scorer apparatus 102 and the trimming shear apparatus 103.

Additionally, an air cylinder and a lock mechanism may be provided in each of the slitter apparatus 1 and the scorer apparatus 102 to fix a position of each of the slitter apparatus 1 and the scorer apparatus 102 in a direction parallel to the conveyance direction FD. In this case, the air cylinder is driven to set the lock mechanism to a lock state so as to fix each of the slitter apparatus 1 and the scorer apparatus 102 at a position where each of the slitter apparatus 1 and the scorer apparatus 102 is to be operated. Alternatively, respective positions of the slitter apparatus 1 and the scorer apparatus 102 may be fixed only by using the motors 120*a*, 122*a* of the movement mechanisms 120, 122. That is, respective positions of the slitter apparatus 1 and the scorer apparatus 102 may be fixed by the motors 120*a*, 122*a* each set in a non-drive state.

<Functions/Effects>

Next, functions/effects of the corrugated paperboard sheet processing apparatus, the corrugated paperboard sheet composite processing apparatus and the processing module according to the above embodiment in the present invention will be described.

In the slitter apparatus 1 as the corrugated paperboard sheet processing apparatus according to the present embodiment, the slitter knife 14 for slitting the corrugated paperboard sheet, the rotational drive motor 36 for driving the slitter knife 14, and the width-direction movement motor 26 and the up-down movement motor 34 for moving the slitter knife 14, respectively, in the width direction of the corrugated paperboard sheet and in the up-down direction, are integrally assembled as the processing module 50, wherein the processing module 50 is configured such that an entirety thereof can be attached and detached with respect to the rotor 22 threadingly engaged with the threaded shaft 12 disposed to extend in the width direction of the corrugated paperboard sheet and the frame 20 holding the rotor 22. That is, in the present embodiment, a plurality of components comprised in the slitter apparatus 1 are integrally assembled to form the processing module 50, wherein the threaded shaft 12 is kept from penetrating the processing module 50, and the processing module 50 is configured such that an entirety thereof can be attached and detached with respect to the frame 20 coupled to the threaded shaft 12.

In the slitter apparatus 1 according to the present embodiment, when a malfunction or breakdown occurs in the processing module 50, the entire processing module 50 can be detached from the frame 20, whereafter another new processing module 50 may be attached to the frame 20, so that it becomes possible to easily and quickly cope with a breakdown, as compared to the conventional technique of, in a situation where a plurality of components comprised in a corrugated paperboard sheet processing apparatus are not modularized, identifying a broken one of the components and performing replacement with respect to each component. Specifically, in the present embodiment, a plurality of components comprised in the slitter apparatus 1 are integrally constructed as the processing module 50 capable of being attached and detached with respect to the frame 20. Thus, when a breakdown occurs somewhere in the processing module 50, irrespective of in which of the components of the processing module 50 the breakdown occurs, it becomes possible to adequately cope with the breakdown by replacing the entire processing module 50 with a new one, without the operation of identifying a broken one of the components and replacing the identified component with a new one, individually. In this case, it is possible to perform a replacement operation to cope with a breakdown, within a shorter period of time, irrespective of in which of the components of the processing module 50 the breakdown occurs.

As mentioned above, in the present embodiment, it becomes possible to significantly shorten a time for an operation to cope with a breakdown of the slitter apparatus 1, and therefore effectively reduce a time period during which production in the entire line of a corrugated paperboard sheet manufacturing machine is interrupted in the event of the breakdown of the slitter apparatus 1.

More specifically, in the present embodiment, the entire processing module 50 can be easily detached from the frame 20 by: detaching, from the width-direction movement motor 26 of the processing module 50, the timing belt 24 which couples the width-direction movement motor 26 and the rotor 22 together; and detaching, from the frame 20, the detachable member 28 of the processing module 50, to which the width-direction movement motor 26 and the up-down movement motor 34 are fixed. Then, a new processing module 50 can also be easily attached to the frame 20 by: attaching the detachable member 28 of the processing module 50 to the frame 20; and attaching the timing belt 24 to a pulley of the width-direction movement motor 26 of the processing module 50 to couple the rotor 22 and the width-direction movement motor 26 together. Therefore, this feature makes it possible to further shorten the time for the operation to cope with a breakdown of the slitter apparatus 1.

One reason why the processing module 50 can be easily replaced is that the threaded shaft 12 is kept from penetrating the processing module 50. On the other hand, it can be said that the rotor 22 penetrated by the threaded shaft 12, the frame 20 holding the rotor 22, and the timing belt 24 wound around the rotor 22, are less easily detached. Thus, it is desirable that such less easily detachable components are designed with a higher factor of safety than that of the components constituting the processing module 50, so as to more reliably avoid the occurrence of a breakdown.

In the present embodiment, the processing module 50 is employed in the slitter apparatus 1. In the slitter apparatus 1, as a feature of the processing of slitting the corrugated paperboard sheet, a load is inevitably applied to each component and therefore a breakdown is more likely occur due to wear or the like. Thus, it is an effective way to employ the processing module 50 in the slitter apparatus 1. In the present embodiment, the grinding device 40 is also incorporated into the processing module 50, so that it becomes possible to replace the processing module 50, including the grinding device 40.

The corrugated paperboard sheet composite processing apparatus 100 according to the present embodiment is configured such that the slitter apparatus 1 comprising the processing module 50 can be spaced apart from the adjacent scorer apparatus 102. Thus, when a worker performs a replacement operation for the processing module 50 of the slitter apparatus 1, the slitter apparatus 1 and the scorer apparatus 102 can be spaced apart from each other to adequately create a workspace for the worker. This makes it possible to more quickly and easily perform the replacement operation for the processing module 50 of the slitter apparatus 1 and thus further shorten a time period during which the production in the entire line of the corrugated paperboard sheet manufacturing machine is interrupted in the event of the breakdown.

<Modifications>

Some modifications of the above embodiment will be described below.

(Modification 1)

Figure 7:
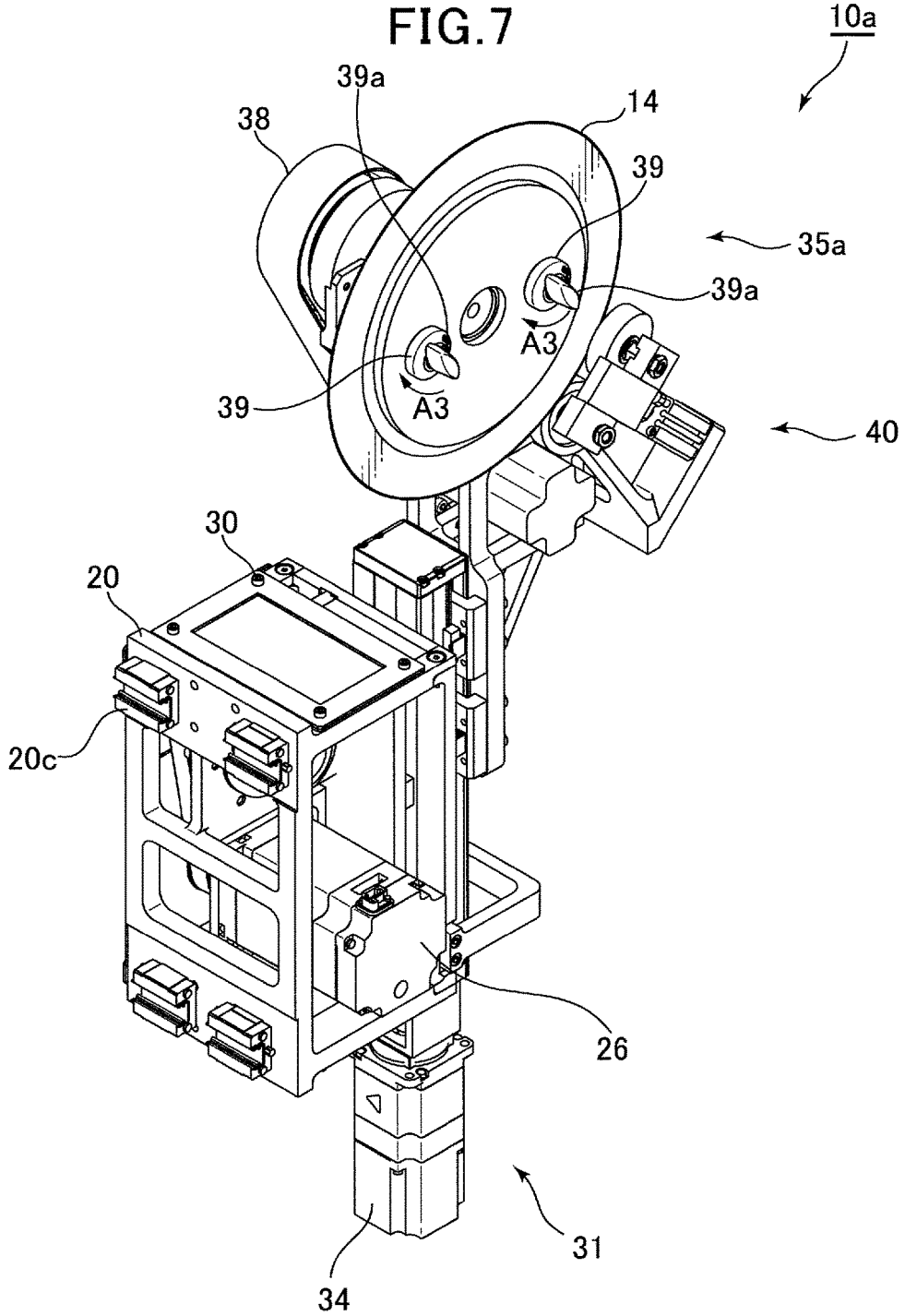
FIG. 7 is a perspective view depicting a slitter knife unit in a modification of an embodiment of the present invention.

With reference to FIG. 7, a slitter knife unit in a modification of the above embodiment will be described. FIG. 7 is a perspective view depicting the slitter knife unit in the modification of the present invention.

As depicted in FIG. 7, the slitter knife unit 10*a* in the modification is different from the slitter knife unit 10 in the above embodiment, in terms of the configuration of the slitter knife section 35. Specifically, in a slitter knife section 35*a* in the modification, the slitter knife 14 is detachably attached to a knife body of the slitter knife section 35*a* through two lock mechanisms 39 (The above embodiment is based on an assumption that the slitter knife 14 is fixed by a bolt or the like). Each of the lock mechanisms 39 comprises a knob member 39*a* configured to be manually operated so as to allow the slitter knife 14 to be detached. Specifically, in FIG. 7, each of the lock mechanisms 39 is in a lock state, so that the slitter knife 14 is fixed by the lock mechanisms 39. In this state, when each of the knob members 39*a* of the lock mechanisms 39 is turned in the direction indicated by the arrowed line A3, each of the lock mechanisms 39 is set in an unlock state, so that the slitter knife 14 can be detached from the knife body of the slitter knife section 35*a*.

In this modification, it becomes possible to attach and detach the slitter knife 14 without using a tool or the like, and thus easily replace the slitter knife 14 with a new one.

(Modification 2)

In the above embodiment, the processing module 50 is employed in the slitter apparatus 1. However, a processing module having a configuration similar to that of the processing module 50 may be employed in various types of corrugated paperboard sheet processing apparatuses. For example, the processing module according to the present invention may be employed in any other type of corrugated paperboard sheet processing apparatus, such as a scorer apparatus (see FIG. 5), a trimming shear apparatus (see FIG. 5), a printing apparatus for printing a corrugated paperboard sheet by an ink-jet process, or a perforating apparatus for perforating a corrugated paperboard sheet. When the processing module is employed in an ink jet printing apparatus, the aforementioned drive device is a printing head drive device such as a piezoelectric type or a bubble type. Further, in the case where the processing module is employed in any one of the above corrugated paperboard sheet processing apparatuses, a movement mechanism similar to one of the aforementioned movement mechanisms 120, 122, 130 (see FIG. 5) is preferably used to allow the corrugated paperboard sheet processing apparatus to be spaced apart from an apparatus adjacent to the corrugated paperboard sheet processing apparatus.

What is claimed is:

1. A corrugated paperboard sheet processing apparatus for processing a corrugated paperboard sheet being conveyed, by moving a processing tool in an up-down direction and a width direction of the corrugated paperboard sheet, comprising:

a threaded shaft disposed to extend in the width direction of the corrugated paperboard sheet;

a support assembly supported by the threaded shaft and comprised of a rotor threadingly engaged with the threaded shaft, the support assembly being guided and moved by the rotor, along the threaded shaft in the width direction of the corrugated paperboard sheet, in response to rotation of the rotor;

a processing module supported by the support assembly and configured to process the corrugated paperboard sheet being conveyed, the processing module being comprised of:

a width-direction movement motor for rotating the rotor to move the support assembly in the width direction of the corrugated paperboard sheet together with the processing module;

a processing tool for performing a given processing on the corrugated paperboard sheet being conveyed relative to the processing tool;

a processing tool drive device for driving the processing tool to perform the given processing; and an up-down movement motor for moving the processing tool in the up-down direction relative to the corrugated paperboard sheet; and a separator member operable to release the processing module from the support assembly to part the processing module from the support assembly, wherein the processing module is configured to define itself as independent and separable from the support assembly and devoid of a direct contact with the threaded shaft.

2. The corrugated paperboard sheet processing apparatus according to claim 1, wherein the processing module comprises a detachable member which is detachably attached to the support assembly, and to which the width-direction movement motor and the up-down movement motor are fixed, wherein the width-direction movement motor is coupled to the rotor by a belt, and wherein the up-down movement motor is operable to move the processing tool drive device together with the processing tool, in the up-down direction with respect to the detachable member.

3. The corrugated paperboard sheet processing apparatus according to claim 1, wherein the processing tool of the processing assembly comprises a slitter knife for slitting the corrugated paperboard sheet.

4. The corrugated paperboard sheet processing apparatus according to claim 3, wherein the processing module further comprises a grinding device operable to grind the slitter knife, and wherein the up-down movement motor is operable to move the grinding device together with the slitter knife, in the up-down direction.

5. A corrugated paperboard sheet composite processing apparatus for performing various types of processing on a corrugated paperboard sheet being conveyed relative to the corrugated paperboard sheet composite processing apparatus, comprising:

a first processing apparatus composed of the corrugated paperboard sheet processing apparatus according to claim 1;

a second processing apparatus provided on an upstream or downstream side of the first processing apparatus and disposed adjacent to the first processing apparatus, the second processing apparatus configured to perform a second processing on the corrugated paperboard sheet which is different from a first processing performed by first processing apparatus on the corrugated paperboard; and a movement mechanism configured to move at least one of the first processing apparatus and the second processing apparatus in a direction parallel to a conveyance direction of the corrugated paperboard sheet to allow the first and second processing apparatuses to be spaced apart from each other.

6. A processing module for processing a corrugated paperboard sheet, the processing module being supported by a support assembly for movement, together with the support assembly, along a threaded shaft disposed to extend in a width direction of the corrugated paperboard sheet, the processing module comprising:

a processing tool operable to perform a given processing on the corrugated paperboard sheet;

a processing tool drive device operable to drive the processing tool to perform the given processing on the corrugated paperboard sheet; and an up-down movement motor operable to move the processing tool in an up-down direction relative to the corrugated paperboard sheet; and a width-direction movement motor operable to rotate a rotor being provided in the support assembly and threadingly engaged with the threaded shaft, the support assembly being being guided and moved by the rotor, along the threaded shaft in the width direction of the corrugated paperboard sheet, in response to rotation of the rotor, wherein the processing module is configured to define itself as independent and separable from the the support assembly, and is devoid of a direct contact with the threaded shaft.

* * * * *